US008317232B2

(12) United States Patent
Syrjänen

(10) Patent No.: US 8,317,232 B2
(45) Date of Patent: Nov. 27, 2012

(54) MULTILAYER INFORMATION PAGE

(75) Inventor: Taru Syrjänen, Vantaa (FI)

(73) Assignee: Setec Oy, Vantaa (FI)

( * ) Notice: Subject to any disclaimer, the term of this patent is extended or adjusted under 35 U.S.C. 154(b) by 548 days.

(21) Appl. No.: 11/917,028

(22) PCT Filed: Jun. 8, 2006

(86) PCT No.: PCT/FI2006/050243

§ 371 (c)(1),
(2), (4) Date: Jun. 17, 2008

(87) PCT Pub. No.: WO2006/131604

PCT Pub. Date: Dec. 14, 2006

(65) Prior Publication Data

US 2008/0309066 A1 Dec. 18, 2008

(30) Foreign Application Priority Data

Jun. 10, 2005 (EP) ..... 05105106
Jun. 29, 2005 (EP) ..... 05105779

(51) Int. Cl.
*B42D 1/00* (2006.01)
*B42D 19/00* (2006.01)
*B42D 15/00* (2006.01)
*B42D 15/10* (2006.01)

(52) U.S. Cl. ..... 283/98; 281/2; 281/5; 283/61; 283/62; 283/72; 283/81; 283/94; 283/101; 283/901

(58) Field of Classification Search ..... 281/2, 5, 281/51; 283/61, 62, 72, 94, 98, 101, 103, 283/117, 901, 81
See application file for complete search history.

(56) References Cited

U.S. PATENT DOCUMENTS

| | | | | |
|---|---|---|---|---|
| 5,380,695 | A | 1/1995 | Chiang et al. | |
| 6,284,337 | B1 | 9/2001 | Lorimor et al. | |
| 6,955,839 | B2 * | 10/2005 | Gocho et al. | 283/904 |
| 2004/0209028 | A1 * | 10/2004 | Gosselin | 283/81 |

FOREIGN PATENT DOCUMENTS

| | | | |
|---|---|---|---|
| EP | 1 245 407 | A2 | 10/2002 |
| EP | 1 380 442 | A1 | 1/2004 |
| EP | 1 516 749 | A2 | 3/2005 |
| WO | 90/00980 | A1 | 2/1990 |

(Continued)

*Primary Examiner* — Dana Ross
*Assistant Examiner* — Justin V Lewis
(74) *Attorney, Agent, or Firm* — Panitch Schwarze Belisario & Nadel LLP

(57) ABSTRACT

The present invention relates to a multilayer information page (1) for a security document, which includes an information part (3) allowing at least some information to be entered into the information page, a flexible and bending resistant connecting part (2) for connecting the information page to the security document, and a surface film (7) which at least partly covers the information part (3) and the connecting part (2) and which is fastened to the information page (1) by lamination. In order to make a possible attempt at forgery even easier to detect, a visible pattern (8) is provided between the connecting part (2) and the surface film (7), and between the visible pattern (8) and the surface film (7) or, correspondingly, between the visible pattern (8) and the connecting part (2), a detachment layer (9) is arranged which consists of separately residing areas preventing the connecting part (2) or, correspondingly, the surface film (7) from becoming firmly attached to the visible pattern (8).

8 Claims, 1 Drawing Sheet

FOREIGN PATENT DOCUMENTS

| | | | |
|---|---|---|---|
| WO | 95/29066 | A1 | 11/1995 |
| WO | 98/19870 | A1 | 5/1998 |
| WO | 2004/043708 | A1 | 5/2004 |
| WO | 2004/110780 | A1 | 12/2004 |
| WO | 2005/028209 | A2 | 3/2005 |

* cited by examiner

MULTILAYER INFORMATION PAGE

CROSS-REFERENCE TO RELATED APPLICATION

This application is a Section 371 of International Application No. PCT/FI2006/050243, filed Jun. 8, 2006, which was published in the English language on Dec. 14, 2006, under International Publication No. WO 2006/131604 A1 and the disclosure of which is incorporated herein by reference.

FIELD OF THE INVENTION

The present invention relates to a multilayer information page for a security document, such a passport, and particularly to a solution whereby such an information page is left with visible marks if an attempt at changing its information part has been made.

DESCRIPTION OF THE PRIOR ART

Properties to be required from an information page of a security document are partly contradictory. First, the structure of an information part of the information page, whereto information of the information page has been entered, should make it impossible for a forger to disassemble the information part. A further requirement is that at least some of the information of the information page can be entered thereto by utilizing laser engraving. In order to achieve these goals, in practice the information part has to be manufactured of a material whose bending properties and bending resistance are poor.

However, an information page should have good bending properties as well as good bending resistance. Consequently, it is necessary to fasten a flexible and bending durable connecting part to the information part so as to enable the information page to be connected to the security document. In order to achieve a sufficient security level, the information part of the information page is to be connected to the connecting part in a manner not allowing these parts to be detached from one another without leaving visible marks to reveal this.

SUMMARY OF THE INVENTION

An object of the present invention is to provide a solution which makes it even more difficult to detach an information part and a connecting part for an information page from one another without leaving visible marks to reveal this. This object is achieved by a method in accordance with the attached independent claim 1 as well as by an information page in accordance with the attached independent claim 2.

The invention includes forming a predetermined visible pattern between the connecting part and a surface film so as to enable an attempt at detaching an information part from the connecting part to be detected due to irregular breakage of the predetermined visible pattern.

In order to ensure such irregular breakage of the visible pattern, a detachment layer consisting of separately residing areas is used in connection with the visible pattern. The detachment layer is arranged between the visible pattern and the connecting part or, alternatively, between the visible pattern and the surface film. The areas of the detachment layer prevent the visible pattern from sticking firmly to the connecting part or, correspondingly, to the surface film. On the other hand, at points where no areas of the detachment layer exist, the visible pattern, in connection with the manufacture of the information page, sticks firmly to the connecting part or to the surface film. When an attempt is then made to detach the surface film from the information page, the areas of the detachment layer cause the visible pattern to break irregularly in a manner which produces a permanent mark. The detachment of the information part of the information page and replacement thereof by another information part are thus detectable due to this irregular breakage.

The visible pattern utilized in the invention may consist e.g. of a security element, such as a hologram, which is manufactured of an easily tearable material. Alternatively, the visible pattern may consist e.g. of a pattern formed on the surface film or the connecting part by means of printing ink. In the present context, a printing ink refers to any colourant or paint which in industrial mass production can be spread in a controlled manner onto a surface of the connecting part or the surface film so as to produce a desired pattern.

Preferred embodiments of the information page in accordance with the invention are disclosed in the attached dependent claims 3 to 7.

BRIEF DESCRIPTION OF THE DRAWINGS

In the following, the invention will be described in closer detail by way of example and with reference to the accompanying drawings, in which.

DESCRIPTION OF SOME EMBODIMENTS

Figure 1:
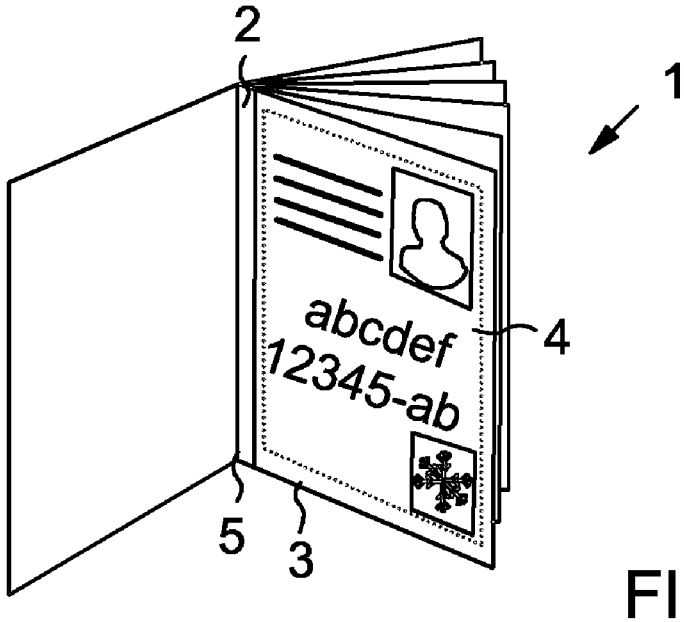
FIG. 1 shows an information page connected to a security document.

FIG. 1 shows an information page 1 according to the invention connected to a security document. In the example of FIG. 1, the security document is a passport whereto the information page 1 has been fastened by means of its connecting part 2. The information page 1 can be fastened to the security document e.g. by means of a stitch 5, i.e. in the same manner as other pages included in the security document.

Information, such as the name, date of birth, photograph, et cetera of the owner of the passport, has been entered into an information area 4 in an information part 3 of the information page.

Figure 2:
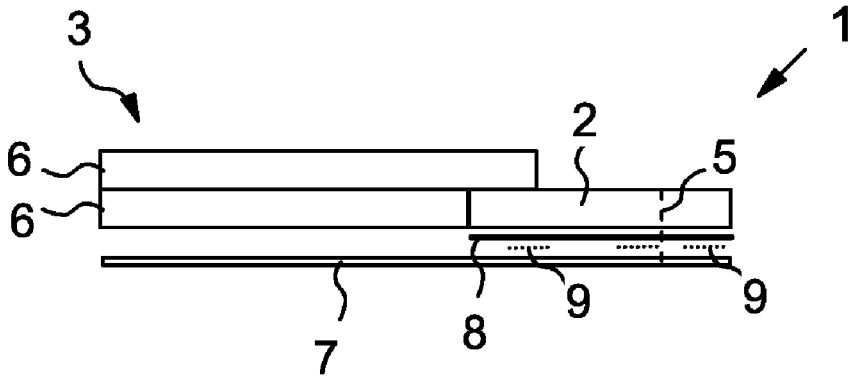
FIG. 2 illustrates a first preferred embodiment of an information page according to the invention.

FIG. 2 illustrates a structure of an information page according to the invention and a method of manufacturing the same. In FIG. 2, the information page is shown in a position in which a photograph and personal information entered into the information page can be read from an upper surface of the information page.

In the case of FIG. 2, polycarbonate films 6 forming the information part as well as the connecting part 2 are with respect to one another set in a position in which they will reside in a finished information page. A lower surface of the connecting part 2 is provided with a visible pattern 8 by means of printing ink. The printing ink may be e.g. an air drying offset printing ink, which enables a desired pattern 8 to be formed e.g. by a printing machine.

The surface of the printing ink 8, in turn, is provided with a detachment layer 9, which is formed by separately residing areas. The material of the detachment layer may be e.g. a non-tacky offset varnish suitable for being spread e.g. by a printing machine. Finally, a clear surface film 7, which may be manufactured e.g. of polyester (PET), is arranged on a lower surface of the information page 1. As the surface film, a material is used which is transparent at least at the visible pattern 8 so as to enable the visible pattern 8 to be seen through the surface film 7.

In the case of FIG. 2 it is by way of example assumed that the surface film covers the lower surface of the entire information page. When the surface film 7 of the information page 1 is fixed in its place by lamination, it thus sticks to the film 6 as well as to the connecting part 2 by means of the visible pattern 8. The detachment layer 9, however, is made of such a material that its separately residing areas prevent the surface layer 7 from sticking firmly to the visible pattern 8 provided on the surface of the detachment part.

If a forger makes an attempt at disassembling the information page 1 shown in FIG. 2 by removing the surface film 7, this results in irregular breakage of the visible pattern 8. At points where areas of the detachment layer 9 exist, the visible pattern 8 remains intact since at these points the detachment layer has prevented the surface film from sticking firmly to the visible pattern 8. On the other hand, at points where no areas of the detachment layer 9 exist, the visible pattern 8 is broken since at these points it has stuck firmly to the surface film 7.

Such irregular breakage involves an advantage that it becomes impossible to forge an information page by replacing the original information part by another one by utilizing the connecting part 2 without this manoeuvre being detected visually due to the irregularly broken visible pattern 8.

In order to make detection of attempts at forgery even more efficient, it is preferable to arrange the areas of the detachment layer irregularly or even randomly. The areas of the detachment layer may be formed e.g. by spheres having a diameter of 2 to 4 mm or by certain letters, e.g. "FIN".

Although above it has been described by way of example and with reference to FIG. 2 that the visible pattern 8 is a visible pattern formed by printing ink, it may be different therefrom and also be an easily tearable security element, e.g. a hologram.

FIG. 2 also shows by way of example that the visible pattern 8 is arranged expressly between the detachment layer 9 and the connecting part 2. According to the invention, however, as distinct from the above, the visible pattern may be arranged between the surface film 7 and the detachment layer 9. In such a case, the visible pattern 8 in its entirety sticks firmly to the surface film 7. On the other hand, the visible pattern 8 then sticks firmly to the connecting part 2 only at points where no areas of the detachment layer 9 exist.

It is to be understood that the above description and the related figures are only intended to illustrate the present invention. It will be obvious to one skilled in the art that the invention can be varied and modified in several ways without deviating from the scope of the invention.

The invention claimed is:

1. A method of manufacturing a multilayer information page for a security document, the information page including at least an information part and a connecting part, the method comprising:

bringing into use a surface film;

arranging, in a space between the surface film and the connecting part, a visible pattern and a detachment layer comprising a plurality of separate, laterally spaced-apart portions, such that the visible pattern and the detachment layer have one of the following arrangements: (1) the surface film being prevented from adhering to the visible pattern at positions of the spaced-apart portions of the detachment layer and being directly adhered to the visible pattern at positions between the spaced-apart portions of the detachment layer, and (2) the connecting part being prevented from adhering to the visible pattern at positions of the spaced-apart portions of the detachment layer and being directly adhered to the visible pattern at positions between the spaced-apart portions of the detachment layer; and fastening the surface film by lamination to the information page such that it covers at least the visible pattern and at least partly the information part.

2. A multilayer information page for a security document, including:

an information part allowing at least some information to be entered into the information page, a flexible and bending resistant connecting part configured to connect the information page to the security document, a surface film at least partly covering the information part and the connecting part and being fastened to the information page by lamination, a visible pattern provided between the connecting part and the surface film, and a detachment layer comprising a plurality of separate, laterally spaced-apart portions, the detachment layer being arranged between the visible pattern and the surface film, the surface film being prevented from becoming attached to the visible pattern at positions of the spaced-apart portions of the detachment layer, and the surface film being directly attached to the visible pattern at positions between the spaced-apart portions of the detachment layer.

3. An information page as claimed in claim 2, wherein the spaced-apart portions of the detachment layer are arranged irregularly with respect to one another.

4. An information page as claimed in claim 2, wherein the information part comprises polycarbonate, and the surface film comprises clear polyester.

5. An information page as claimed in claim 2, wherein the visible pattern comprises an air drying offset printing ink, and the detachment layer comprises a varnish.

6. An information page as claimed in claim 2, wherein the visible pattern comprises a tearable security element.

7. An information page as claimed in claim 6, wherein the security element is a hologram.

8. A multilayer information page for a security document, including:

an information part allowing at least some information to be entered into the information page, a flexible and bending resistant connecting part configured to connect the information page to the security document, a surface film at least partly covering the information part and the connecting part and being fastened to the information page by lamination, a visible pattern provided between the connecting part and the surface film, and a detachment layer comprising a plurality of separate, laterally spaced-apart portions, the detachment layer being arranged between the visible pattern and the connecting part, the connecting part being prevented from becoming attached to the visible pattern at positions of the spaced-apart portions of the detachment layer, and the connecting part being directly attached to the visible pattern at positions between the spaced-apart portions of the detachment layer.

* * * * *